United States Patent [19]

Stout

[11] 4,402,400

[45] Sep. 6, 1983

[54] ARTICLE CARRIER

[75] Inventor: James T. Stout, Acworth, Ga.

[73] Assignee: The Mead Corporation, Dayton, Ohio

[21] Appl. No.: 332,466

[22] Filed: Dec. 21, 1981

[51] Int. Cl.[3] ..... B65D 5/48; B65D 75/00

[52] U.S. Cl. ..... 206/162; 206/188; 206/193; 206/198; 229/28 BC; 229/52 BC

[58] Field of Search ..... 206/170–191, 206/427, 162, 193, 198; 229/28 BC, 52 BC, 37 R

[56] References Cited

U.S. PATENT DOCUMENTS

| | | | |
|---|---|---|---|
| 3,618,757 | 11/1971 | Funkhouser | 206/194 |
| 3,757,991 | 9/1973 | Stout | 206/173 |
| 4,029,205 | 6/1977 | Wood | 206/188 X |
| 4,117,925 | 10/1978 | Wood | 229/28 BC X |
| 4,202,446 | 5/1980 | Sutherland | 206/427 X |

FOREIGN PATENT DOCUMENTS

| | | | |
|---|---|---|---|
| 2254315 | 5/1974 | Fed. Rep. of Germany | 206/187 |

*Primary Examiner*—William T. Dixson, Jr.
*Assistant Examiner*—Gary E. Elkins
*Attorney, Agent, or Firm*—Rodgers & Rodgers

[57] ABSTRACT

An article carrier comprising a bottom wall, a pair of side walls joined respectively to the side edges of the bottom wall, end wall panels joined respectively to the end edges of the side walls to form opposing end walls, riser panels joined respectively to the inner edges of the end wall panels, a multiple ply handle extending between the riser panels, and the width of the bottom wall being less than the width of the end walls.

4 Claims, 6 Drawing Figures

ARTICLE CARRIER

TECHNICAL FIELD

This invention relates to article carriers which are economical to produce and, at the same time, allow for easy stacking. In addition the articles are held tightly in their proper packaged positions.

BACKGROUND ART

Article carriers of interest in connection with this invention are disclosed in U.S. Pat. Nos. 3,757,991 and 3,618,757.

DISCLOSURE OF THE INVENTION

According to this invention in one form, an article carrier is provided and comprises a bottom wall, spaced side walls joined to the bottom wall and extending upwardly therefrom, end wall panels joined respectively to the end edges of the side walls and extending inwardly therefrom, to form opposing end walls, riser panels joined to the inner edges of the end wall panels and extending medially inward of the carrier, a multiple ply handle extending between the riser panels, and the width of the bottom wall as measured along the end walls being less than the width of the end walls.

BEST MODE FOR CARRYING OUT THE INVENTION

Figure 1:
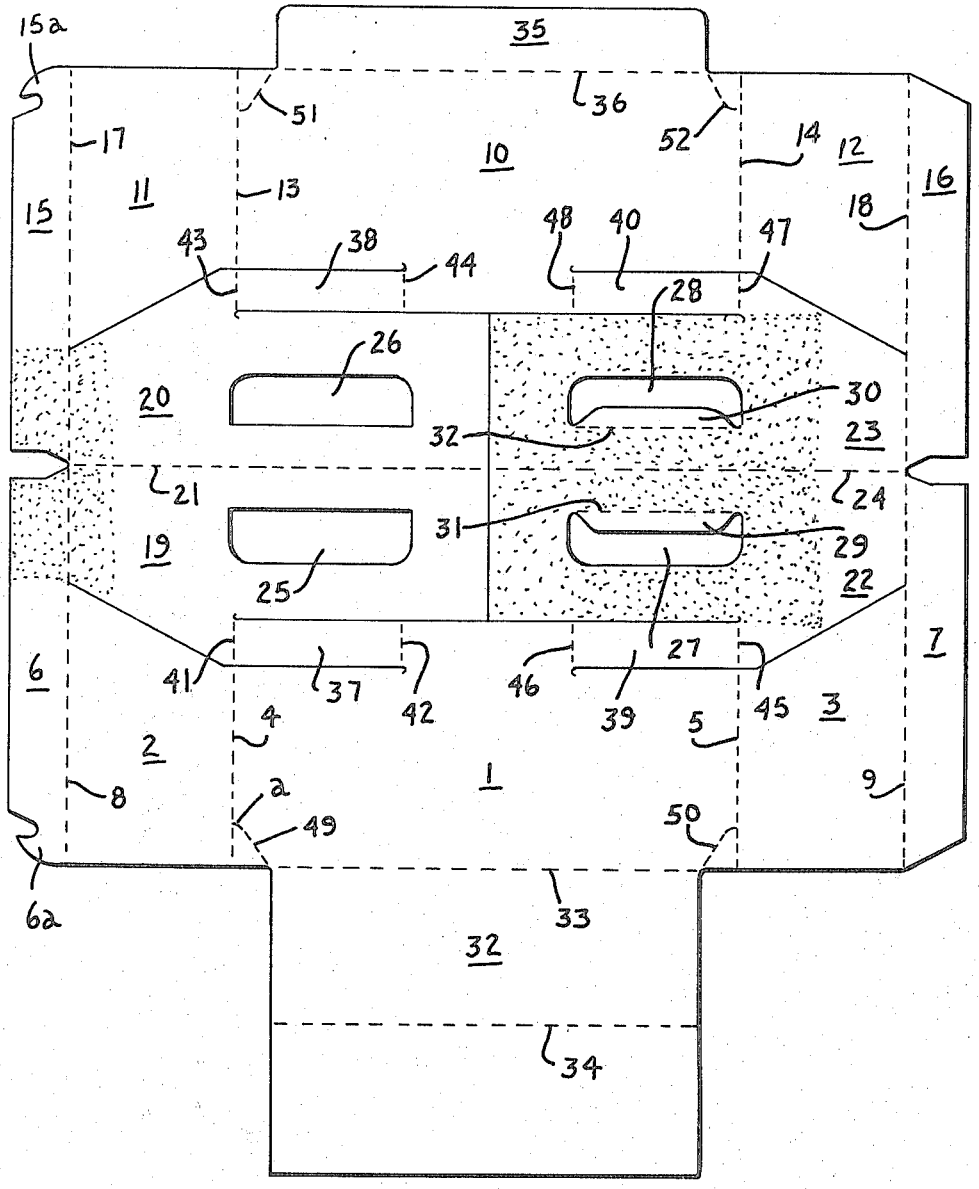
FIG. 1 is a plan view of the blank from which the article carrier is constructed according to this invention.

In the drawings the numeral 1 designates a side wall of the carrier to the side edges of which end wall panels 2 and 3 are joined respectively along fold lines 4 and 5. Riser panels 6 and 7 are joined respectively to end wall panels 2 and 3 along fold lines 8 and 9, and riser panel 6 is provided with locking notch 6*a*.

The opposite end of the blank is of a similar construction and comprises side wall 10 to the side edges of which end wall panels 11 and 12 are joined respectively along fold lines 13 and 14. Also riser panels 15 and 16 are joined respectively to end wall panels 11 and 12 along fold lines 17 and 18. Riser panel 15 is provided with locking notch 15*a*.

Handle structure for the carrier is provided in the form of inner handle panels 19 and 20 which are joined respectively to riser panels 6 and 15 along fold lines 8 and 17. Also inner handle panel 19 is joined to inner handle panel 20 along fold line 21. Similarly outer handle panels 22 and 23 are joined respectively to riser panels 7 and 16 along fold lines 9 and 18 and are joined together along fold line 24.

For the purpose of facilitating handling of the carrier, hand gripping apertures 25, 26, 27 and 28 are formed respectively in handle panels 19, 20, 22 and 23. In addition hand cushioning flaps 29 and 30 are foldably joined respectively to outer handle panels 22 and 23 along fold lines 31 and 32.

The bottom wall for the carrier is identified by the numeral 32 and is foldably joined to the lower edge of side wall 1 along fold line 33. Also bottom wall 32 is provided with medial fold line 34. For the purpose of cooperating with bottom wall 32, glue flap 35 is joined to the lower edge of side wall 10 along fold line 36.

Transverse partitioning means is provided for the carrier in the form of transverse partition straps 37, 38, 39 and 40. More specifically transverse partition strap 37 is joined to inner handle panel 19 along fold line 41 and to side wall 1 along fold line 42. Similarly transverse partition strap 38 is joined to inner handle panel 20 along fold line 43 and to side wall 10 along fold line 44. Transverse partition strap 39 is joined to outer handle panel 22 and side wall 1 respectively along fold lines 45 and 46. Finally transverse partition strap 40 is joined to outer handle panel 23 and side wall 10 respectively along fold lines 47 and 48.

According to this invention, the width of bottom wall 32, as measured along the end walls formed respectfully by the two end wall panels at each end of the carrier, is less than the width of the end walls. In this connection, fold lines 49 and 50 are formed in side wall 1 and, similarly fold lines 51 and 52 are formed in side wall 10. In addition fold lines 49–52 extend from the respective corners of bottom wall 32 and the end of each fold line 49–52 adjacent the corresponding end wall panel is of a hook shaped configuration and is identified by the letter "a".

Figure 2:
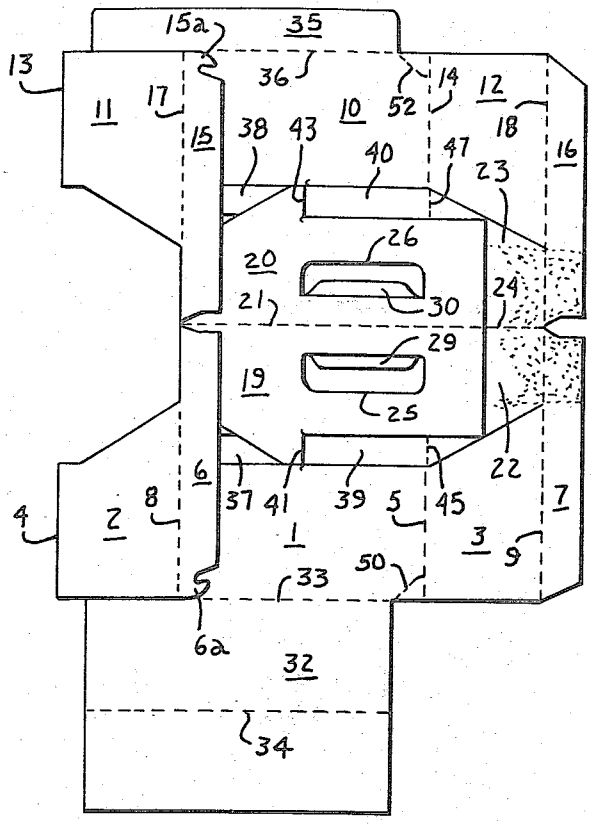

In order to form the carrier from the blank shown in FIG. 1, initially it is necessary to make an application of glue to inner handle panels 19 and 20, outer handle panels 22 and 23 and riser panels 6 and 15 as shown by stippling in FIG. 1. Then it is simply necessary to elevate inner handle panels 19 and 20, end wall panels 2 and 11 and riser panels 6 and 15 upwardly and over to the right along fold lines 8, 17 and 41–44. The blank then appears as shown in FIG. 2 wherein riser panels 6 and 15 are adhered respectively to inner handle panels 19 and 20. In addition the outer surfaces of inner handle panels 19 and 20 are adhered to the inner surfaces respectively of outer handle panels 22 and 23.

Figure 3:
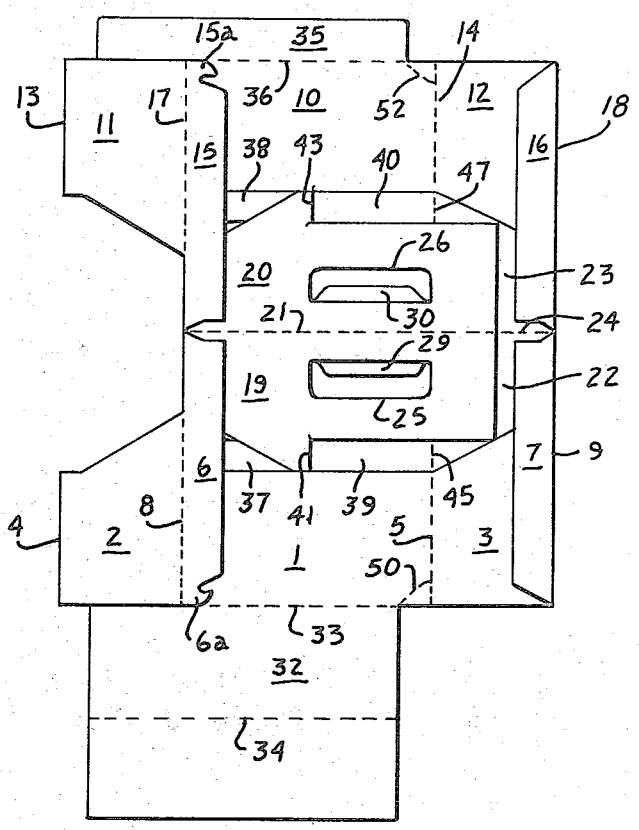
FIGS. 2, 3 and 4 depict intermediate stages through which the blank of FIG. 1 is manipulated and glued in order to form a complete and collapsed carrier as shown in FIG. 5.

Following this operation, an application of glue is made to riser panels 7 and 16 and outer handle panels 22 and 23 as shown by stippling in FIG. 2. Then riser panels 7 and 16 are simply elevated and folded over to the left respectively along fold lines 9 and 18 and adhered respectively to outer handle panels 22 and 23. The blank then appears as shown in FIG. 3.

Figure 5:
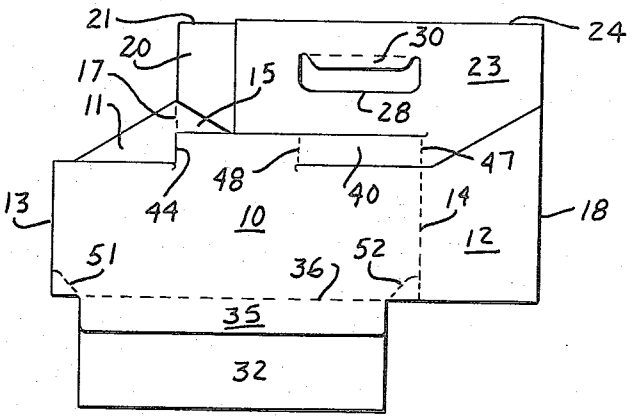
Figure 4:
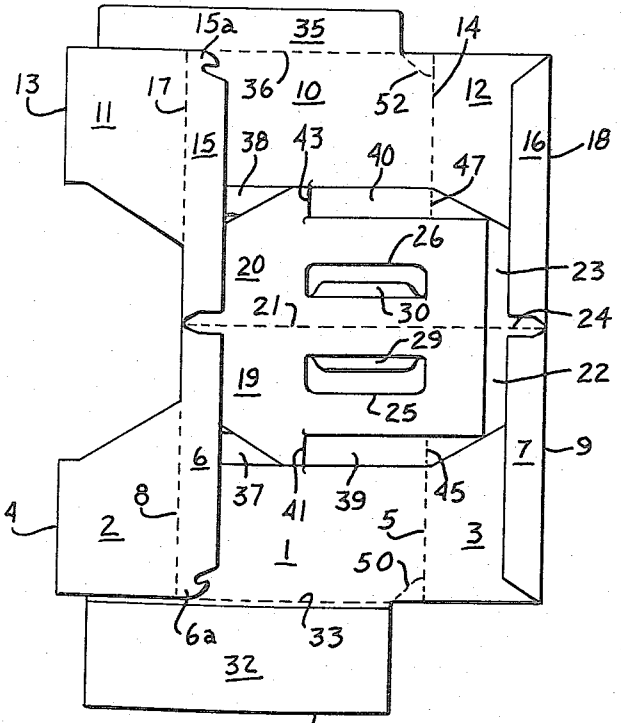

Then the lower portion of the bottom wall 32 is elevated and folded over along fold line 34 to occupy the position shown in FIG. 4. Next an application of glue is made to glue flap 35, riser panels 6, 7, 15 and 16 and handle panels 19, 20, 22 and 23 and the entire portion of the blank disposed above fold line 21 is elevated and folded over to a position whereby glue flap 35 is adhered to bottom wall 32. The blank then appears as shown in FIG. 5 which represents the article carrier in complete and collapsed condition.

Figure 6:
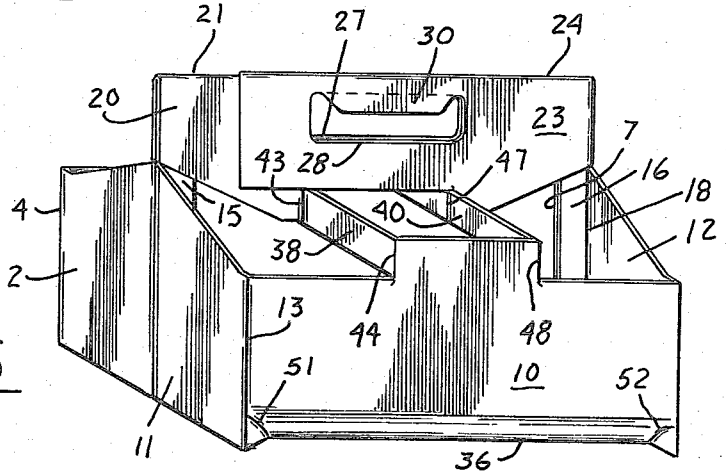
FIG. 6 is a perspective view of an article carrier formed according to this invention.

In order to set up the carrier it is simply necessary to expand side walls 1 and 10 into positions whereby they are perpendicular to end wall panels 2, 3, 11 and 12. In this manner bottom wall 1 is automatically folded into a flat plane and then one end thereof is maneuvered into locking engagement with locking notches 6*a* and 15*a*. The carrier appears as shown in FIG. 6.

As the article carrier is erected according to this invention and since bottom wall 32 is of a width less than the width of the overall carrier, transverse tension occurs across bottom wall 32 and, as a result, the lower portions of side walls 1 and 10 are caused to assume an inwardly bowed configuration. This then allows bottom wall 32 to become taut and lie flat rather than assume a bowed configuration typical with known article carriers. For the purpose of preventing undesirable wrinkling of side walls 1 and 10, fold lines 49–52 are provided and actually absorb the tension which is transferred from bottom wall 32 to side walls 1 and 10 as the carrier is set up and during transport of articles loaded therein. This takes the form of bending of the paperboard material along fold lines 49–52 as best shown in FIG. 6. Hook shaped portions "a" act to prevent any undesirable tearing of the paperboard material.

INDUSTRIAL APPLICABILITY

By this invention an article carrier is provided which is easily stackable and economical to manufacture. In addition the packaged articles are held tightly in their proper packaged positions without detraction from the appearance of the carrier.

I claim:

1. An article carrier comprising a bottom wall, a pair of side walls foldably joined respectively to the side edges of said bottom wall, end wall panels foldably joined respectively to the end edges of said side walls and extending inwardly therefrom to form opposing end walls, riser panels foldably joined respectively to the inner edges of said end wall panels and extending medially inward of the carrier, a multiple ply handle extending between said riser panels, the width of said bottom wall as measured along said end walls being less than the width of said end walls, the lower portions of said side walls being of inwardly bowed configurations, and a fold line extending from one corner of said bottom wall to the fold line between the associated side wall and adjacent end wall panel.

2. An article carrier according to claim 1 wherein the end portion of said fold line adjacent said end wall panel is of a hook shaped configuration.

3. An article carrier according to claim 1 wherein at least one transverse partition strap extends from said handle to the associated one of said side walls on each side of said carrier.

4. An article carrier according to claim 1 wherein a medial fold line is formed in said bottom wall.

* * * * *